US009419385B2

(12) United States Patent
Peng et al.

(10) Patent No.: US 9,419,385 B2
(45) Date of Patent: Aug. 16, 2016

(54) CABLE CONNECTOR ASSEMBLY WITH IMPROVED SHELL

(71) Applicant: HON HAI PRECISION INDUSTRY CO., LTD., New Taipei (TW)

(72) Inventors: Fei-Yan Peng, Shenzhen (CN); Xian-Kui Shi, Shenzhen (CN); Jerry Wu, Irvine, CA (US); Jun Chen, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 23 days.

(21) Appl. No.: 14/287,582

(22) Filed: May 27, 2014

(65) Prior Publication Data

US 2014/0349523 A1 Nov. 27, 2014

(30) Foreign Application Priority Data

May 27, 2013 (CN) ..... 2013 2 02935724 U
May 27, 2013 (CN) ..... 2013 2 02940347 U

(51) Int. Cl.
*H01R 13/502* (2006.01)
*H01R 13/6593* (2011.01)

(52) U.S. Cl.
CPC ..... *H01R 13/6593* (2013.01)

(58) Field of Classification Search
CPC ..... H01R 12/53; H01R 27/00; H01R 24/20
USPC ..... 439/660
See application file for complete search history.

(56) References Cited

U.S. PATENT DOCUMENTS 8,011,968 B2 * 9/2011 Lai ..... H01R 13/65802 439/660
8,100,725 B2 * 1/2012 Su ..... H01R 27/00 439/660
8,608,520 B2 * 12/2013 Yuan ..... H01R 12/53 439/886
2012/0309235 A1 * 12/2012 Yuan ..... H01R 12/53 439/660

FOREIGN PATENT DOCUMENTS

CN 202058996 U * 11/2011 ..... H01R 12/53

* cited by examiner

*Primary Examiner* — Abdullah Riyami
*Assistant Examiner* — Nader J Alhawamdeh
(74) *Attorney, Agent, or Firm* — Ming Chieh Chang; Wei Te Chung

(57) ABSTRACT

A cable connector assembly includes a connector and a cable. The connector includes a shell having a front shell and a back shell assembled to each other, an insulative housing, and a number of contacts. The front shell includes a mating portion and a bending portion backwardly extending from the mating portion. The insulative housing includes a body portion and a stepped portion extending backwardly from the body portion. The contact includes a tail portion exposed on the stepped portion. The cable includes a number of conductive wires connected with the tail portions of the contacts. The bending portion is mated with the back shell. The bending portion is aligned with the cable to form an angle with respect to the mating portion.

20 Claims, 4 Drawing Sheets

CABLE CONNECTOR ASSEMBLY WITH IMPROVED SHELL

BACKGROUND OF THE INVENTION

1. Field of the Invention

The present invention relates to a cable connector assembly, and more particularly to the cable connector assembly with improved shell.

2. Description of Related Art

U.S. Pat. No. 8,011,968 discloses a connector and a cable connected with the connector. The connector has a metallic shell, an insulative housing received in the shell, and a plurality of contacts retained on the insulative housing. The shell comprises a front shell enclosing the insulative housing and a back shell attached to the front shell and to a back side of the insulative housing. The front shell comprises a front portion and a rear portion extending from the front portion. The front portion includes a bottom wall, a top wall opposite to the bottom wall, and a pair of side walls extending upwardly from two lateral sides of the bottom wall. The rear portion includes a first wall extending from the bottom wall of the front portion and a pair of second walls extending upwardly from two lateral sides of the first wall. The bottom wall and the first wall are located on a same level.

U.S. Pat. No. 8,608,520 discloses a connector and a cable electrically connected with the connector. The connector has a connector housing, a plurality of contacts received in the connector housing, a printed circuit board electrically connected the connector housing and the cable, an insulating housing at least partly enclosing the printed circuit board, and a metallic shell disposed outside of the insulative housing. The insulating housing comprises a first portion and a second portion bent and backwardly extending from the first portion. The first portion and the second portion are located at different levels, and an extending direction of the cable is same with an extending direction of the second portion. The shell comprises an upper shell and a lower shell engaged with the upper shell. The lower shell comprises a mating portion and a bending portion connected with the mating portion. An extending direction of the bending portion is same with the extending direction of the second portion of the insulative housing.

A cable connector assembly with an improved shell is desired.

BRIEF SUMMARY OF THE INVENTION

Accordingly, an object of the present invention is to provide a cable connector assembly having an improved shell.

In order to achieve the above-mentioned object, a cable connector assembly in accordance with the present invention comprises: a connector including a shell having a front shell and a back shell assembled to each other, an insulative housing received in the shell, and a plurality of contacts retained on the insulative housing, the front shell comprising a mating portion and a bending portion backwardly extending from the mating portion, the insulative housing comprising a body portion and a stepped portion extending backwardly from the body portion, each of the contacts comprising a contact portion, a retaining portion retained on the body portion, and a tail portion exposed on the stepped portion, the contact portion, the retaining portion, and the tail portion extending along a same direction; and a cable comprising a plurality of conductive wires connected with the tail portions of the contacts, the bending portion being mated with the back shell, the bending portion being aligned with the cable to form an angle with respect to the mating portion.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
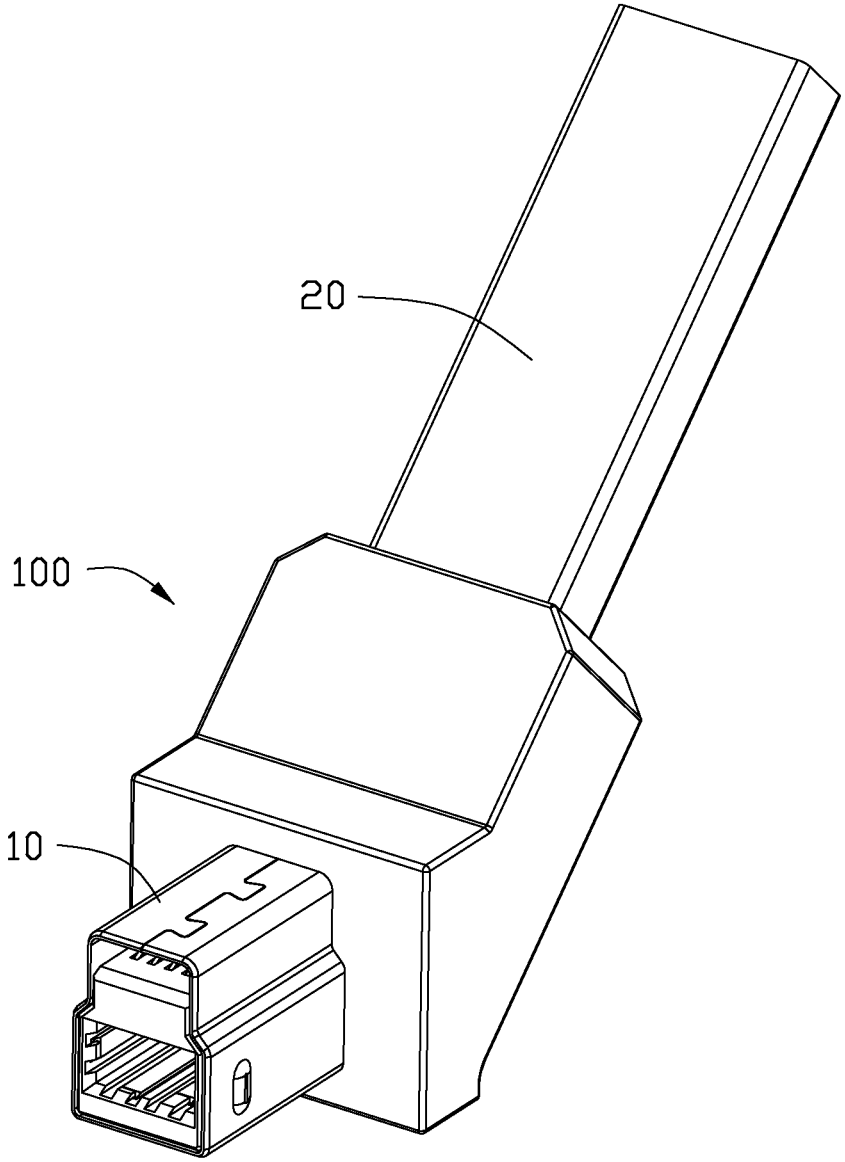
FIG. 1 is a perspective view of a cable connector assembly according to the present invention.
Figure 2:
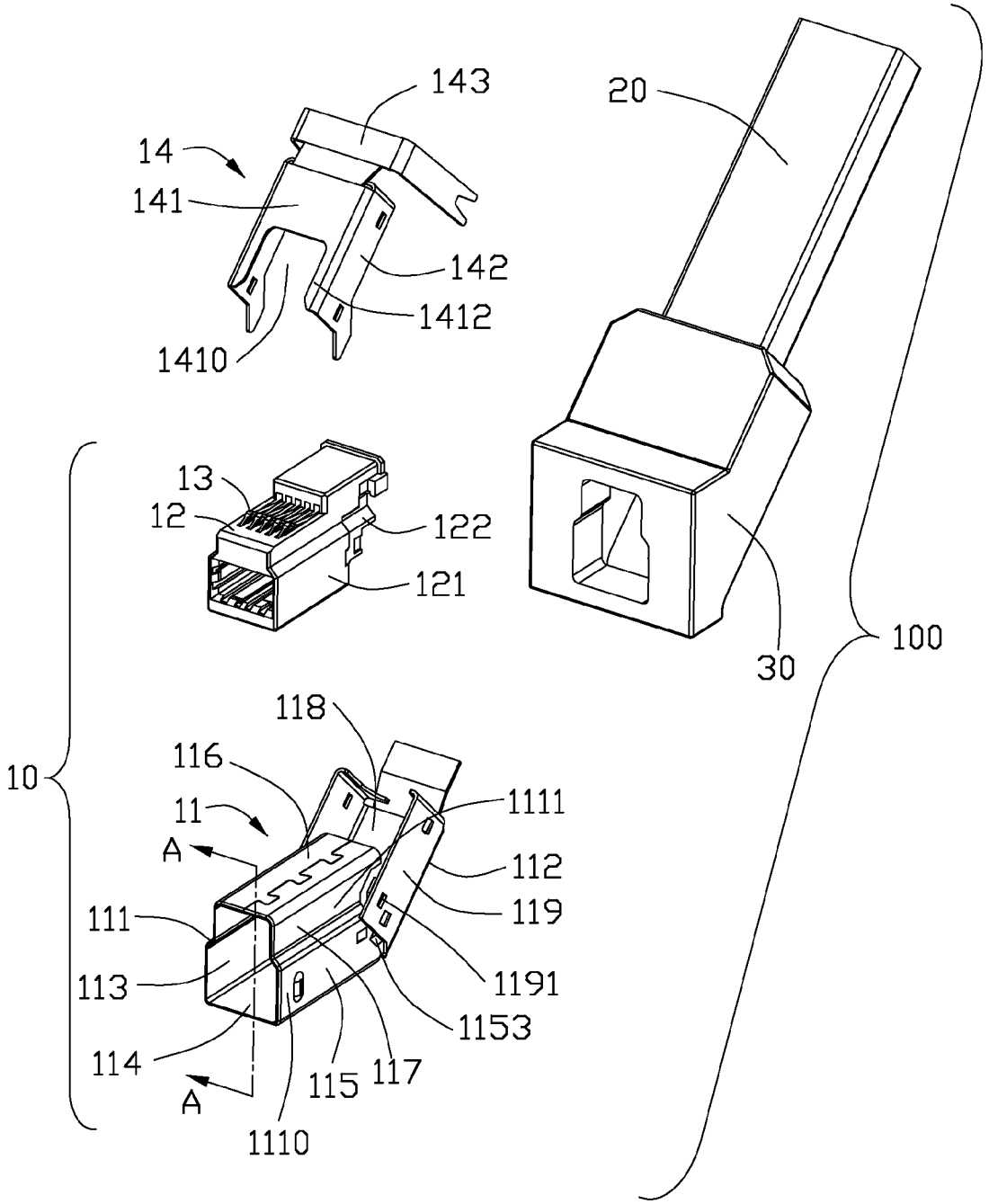
FIG. 2 is an exploded view of the cable connector assembly shown in FIG. 1.
Figure 3:
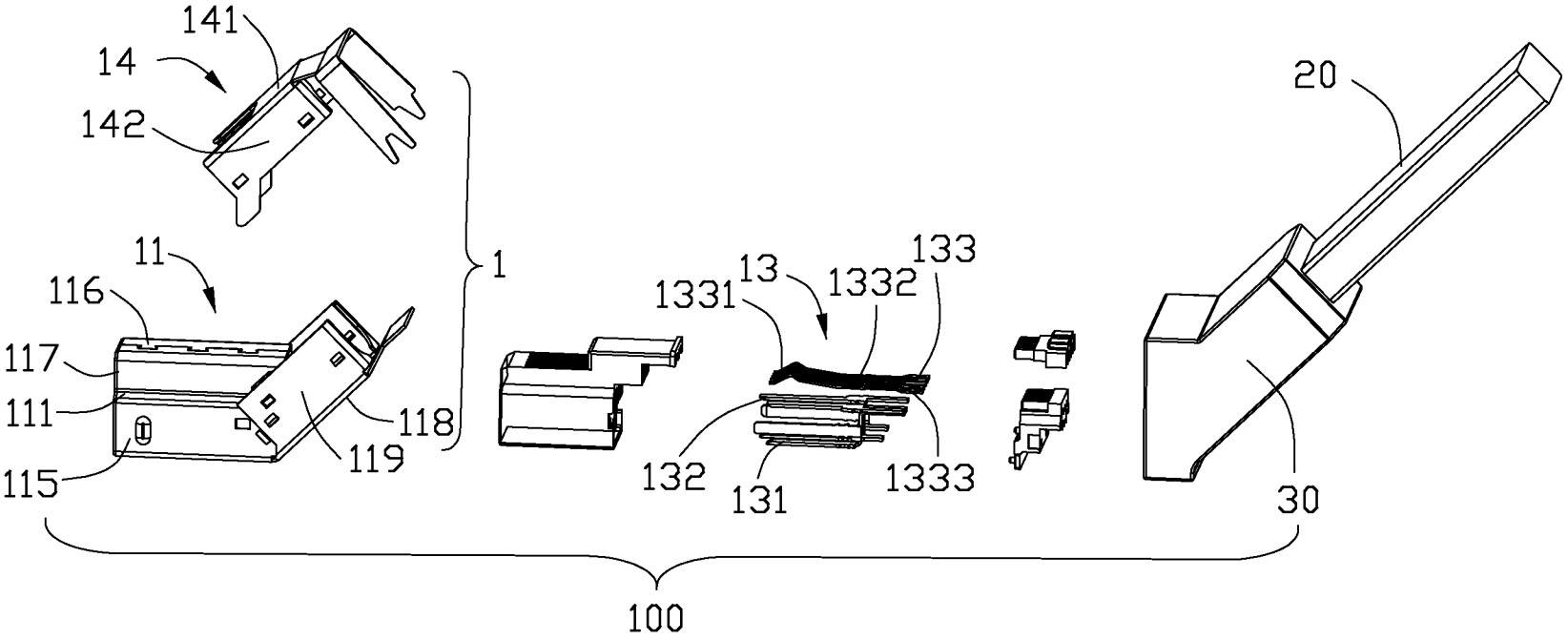
FIG. 3 is an exploded view of the cable connector assembly shown in FIG. 1 from another aspect.
Figure 4:
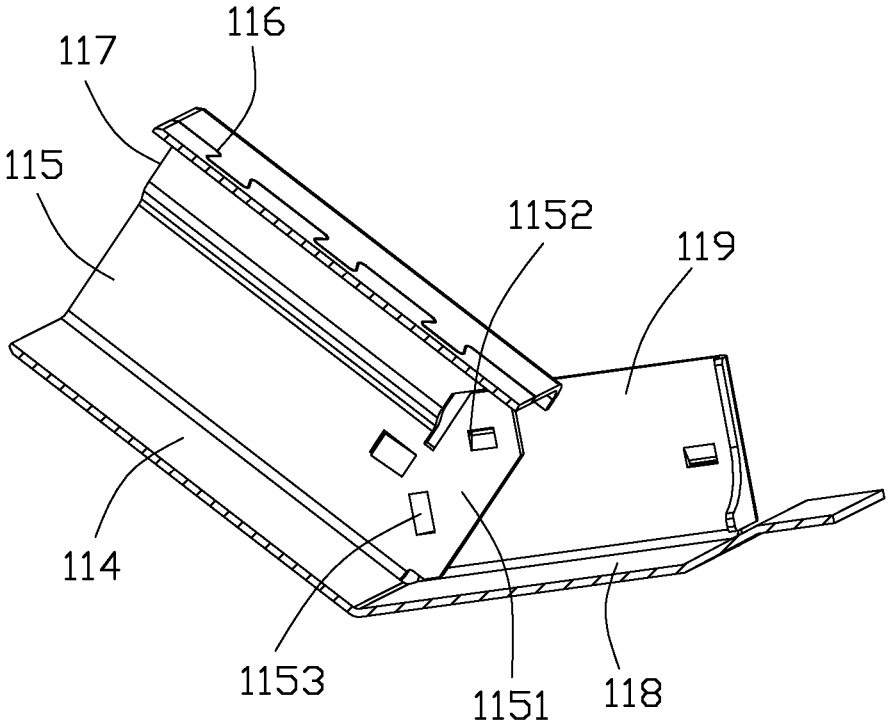
FIG. 4 is a cross section view of the front shell taken along line 4-4 in FIG. 2.

Referring to FIGS. 1 and 4, a cable connector assembly 100 in accordance with the present invention comprises a connector 10, a cable 20 electrically connected with the connector 10, and an insulating sleeve 30 surrounding the connector 10. The connector 10 is a B-type USB 3.0 plug, comprising a shell 1, an insulative housing 12 received in the shell 1, and a plurality of contacts 13 retained on the insulative housing 12. The cable 20 comprises a plurality of conductive wires for signal transmission. The shell 1 is made of metallic material and comprises a front shell 11 and a back shell 14 assembled to each other.

The front shell 11 is stamped from a unitary one-piece metal sheet and comprises a mating portion 111 for connecting with a complementary connector and a bending portion 112 extending backwardly from the mating portion 111. The mating portion 111 comprises a large section 1110, a narrowing section 1111 disposed above the large section 1110, and a receiving space 113 to receive the insulative housing 12. The mating portion 111 comprises a bottom wall 114, a top wall 116 opposite to the bottom wall 114, and a pair of side walls 115 connecting the bottom wall 114 and the top wall 116. A width of the bottom wall 114 is larger than a width of the top wall 116. The bending portion 112 comprises a first wall 118 extending from an end of the bottom wall 114 of the mating portion 111, and a pair of second walls 119 extending upwardly from two lateral sides of the first wall 118. The first wall 118 of the bending portion 112 and the bottom wall 114 of the mating portion 111 are located on different levels. The second wall 119 of the bending portion 112 and the side wall 115 of the mating portion 111 are at least partially overlapped. A gap (not labeled) is formed between the second wall 119 of the bending portion 112 and the narrowing section 1111 of the mating portion 111.

Each of the side walls 115 comprises a guide portion 1151 extending backwardly, an engaging hole 1152 located on the guide portion 1151, and a stop portion 1153. The second wall 119 of the bending portion 112 defines a spring tab 1191 engaged with the engaging hole 1152 to connect the second wall 119 with the side wall 115. A front leading edge of the second wall 119 rests upon the stop portion 1153 for positioning the bending portion 112 and preventing the first wall 118 of the bending portion 112 from excessively bent. A width of the first wall 118 is larger than a width of the bottom wall 114.

The back shell 14 shields the bending portion 112 and comprises an upper wall 141, a mounting portion 142 extending downwardly from two lateral sides of the upper wall 141, and a clamping portion 143 extending backwardly from the upper wall 141. The upper wall 141 comprises a U-shaped recess 1410 and a shielding portion 1412 disposed on the left and right sides of the recess 1410. When the back shell 14 is engaged with the front shell 11, the shielding portion 1412 shields the gap to suppress EMI and the narrowing section 1111 is received in the recess 1410.

The insulative housing 12 comprises a body portion 121 and plural stepped portions 122 extending backwardly from the body portion 121. The stepped portions 122 comprise a first, a second, and a third stepped portions (not labeled) extending backwardly from a rear face of the body portion 121 and spaced apart from each other along a height direction of the insulative housing. It is convenient for the cable to solder with corresponding contacts 13.

The contacts 13 comprise a first contacts 131 retained in the first stepped portion, a second contacts 132 retained in the second stepped portion, and a third contacts 133 retained in the third stepped portion. A length of the second contact 132 is larger than a length of the first contact 131, and a length of the third contact 133 is larger than a length of the second contact 132. Each of the contacts 13 comprises a contacting portion 1331, a retaining portion 1332 retained on the insulative housing 12, and a tail portion 1333 exposed on the stepped portion. The contact portion 1331, the retaining portion 1332, and the tail portion 1333 extend along a same direction. The cable 20 electrically connects with the tail portions 1333 of the contacts 13. Prior to a bending operation, an original extending direction of the cable 20 is same as an extending direction of the contacts 13. After a bending operation, the portion 112 is so bent as to mate with the back shell 14 and at the same time the cable 20 is also bent together with the bending portion 112. An angle is therefore formed between the extending direction of the cable 20 and the mating portion 111. In this embodiment, the angle formed by the cable 20 and the mating portion 111 is about 135 degrees. An angle formed between the first wall 118 and the bottom wall 114 is equal to the angle formed between the cable 20 and the mating portion 111. Compared to prior art design, the angled arrangement saves space while easing its manufacturing.

In assembling of the cable connector assembly 100, the contacts 13 are received in the insulative housing 12. The cable 20 is electrically connected with the corresponding contacts 13. After that, firstly, both the mating portion 111 of the front shell 11 and the bending portion 112 of the front shell 11 are disposed along a same line. Thus, the bottom wall 114 of the mating portion 111 is flush with the first wall 118 of the bending portion 112. Then, the insulative housing 12 together with the contacts 13 and the cable 20 is mounted into the mating portion 111. The bend portion 112 is bent and mates with the back shell 14, leading to the cable 20 being bent with the bending portion 112. Finally, the insulating sleeve 30 surrounds the connector 10.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising: a connector comprising a shell having a front shell and a back shell assembled to each other, an insulative housing received in the shell, and a plurality of contacts retained on the insulative housing, the front shell comprising a mating portion and a bending portion backwardly extending from the mating portion, the insulative housing comprising a body portion and a stepped portion extending backwardly from the body portion, each of the contacts comprising a contact portion, a retaining portion retained on the body portion, and a tail portion exposed on the stepped portion, the contact portion, the retaining portion, and the tail portion extending along a same direction; and a cable comprising a plurality of conductive wires connected with the tail portions of the contacts, the bending portion being mated with the back shell, the bending portion being aligned with the cable to form an obtuse angle with respect to the mating portion.

2. The cable connector assembly as recited in claim 1, wherein the mating portion comprises a bottom wall, a top wall opposite to the bottom wall, a pair of side walls, and a receiving space for receiving the insulative housing, and the bending portion comprises a first wall extending backwardly from an end of the bottom wall and a pair of second walls extending upwardly from two lateral sides of the first wall, the first wall of the bending portion and the bottom wall of the mating portion being located at different levels.

3. The cable connector assembly as recited in claim 2, wherein each of the side walls has an engaging hole, and each of the second walls has a spring tab cooperating with the engaging hole to connect the second wall with the side wall.

4. The cable connector assembly as recited in claim 2, wherein each of the side walls comprises a stop portion, and the second wall has a front leading edge resisted by the stop portion for positioning the bending portion.

5. The cable connector assembly as recited in claim 2, wherein a width of the first wall is generally larger than a width of the bottom wall.

6. The cable connector assembly as recited in claim 2, wherein a width of the top wall is generally smaller than the bottom wall.

7. The cable connector assembly as recited in claim 2, wherein an angle formed between the first wall and the bottom wall is substantially equal to an angle formed between the cable and the mating portion.

8. The cable connector assembly as recited in claim 2, wherein the mating portion comprises a widened section and a narrowed section disposed above the widened section, a gap is formed between the second wall of the bending portion and the narrowed section of the mating portion, and the back shell has a portion shielding the gap.

9. The cable connector assembly as recited in claim 8, wherein the back shell comprises an upper wall, a mounting portion extending downwardly from two lateral sides of the upper wall, and a clamping portion extending backwardly from the upper wall, the shielding portion disposed on the upper wall.

10. The cable connector assembly as recited in claim 2, wherein the back shell comprises a U-shaped recess, the narrowed section received in the recess.

11. The cable connector assembly as recited in claim 4, wherein the second wall comprises a rearward guide portion, the latching portion and the stop portion being disposed on the guide portion.

12. A cable connector assembly comprising:

an insulative housing defining first and second mating ports opposite to each other in a vertical direction, each of said mating ports communicating forwardly with an exterior in a front-to-back direction perpendicular to said vertical direction;

two sets of contacts disposed in the housing with contacting sections exposed into the corresponding mating ports, respectively, and tail sections exposed behind the housing;

a cable linked located behind the housing and rearwardly extending in a rearward oblique direction oblique to both said vertical direction and said front-to-back direction and including a plurality of wires mechanically and electrically connected to the tail sections of the corresponding contacts, respectively, said cable essentially being closer to the second mating port than to the first mating port in said front-to-back direction; wherein said housing defines on a rear side a rearward step structure essentially compliant with said rearward oblique direction, and the tail sections of the contacts are seated upon the step structure for soldering to the corresponding wires, respectively; wherein an angle formed between a forward direction along the front-to-back direction, along which the mating ports forwardly communicate with the exterior, and the rearward oblique direction along which the cable rearwardly extends, is an obtuse one.

13. The cable connector assembly as claimed in claim 12, further including a metallic primary shell and a metallic secondary shell assembled to each other to commonly cover the housing and a front portion of the cable, wherein the primary shell includes unitarily a front frame like structure extending along the front-to-back direction, and a rear U like structure extending along the oblique direction.

14. The cable connector assembly as claimed in claim 13, wherein said secondary shell defines another U like structure extending along said oblique direction to be assembled to said rear U like structure of the primary shell in another oblique direction oblique to both said vertical direction and said front-to-back direction while being perpendicular to said oblique direction.

15. The cable connector assembly as claimed in claim 14, wherein said frame like structure defines a first dimension in the vertical direction and a combination of said rear U like structure of the primary shell and said another U like structure of the second shell commonly define a second dimension along said another oblique direction, said second dimension being smaller than the first dimension.

16. The cable connector assembly as claimed in claim 12, wherein the tail sections of said contacts extend rearwardly in the front-to-back direction.

17. The cable connector assembly as claimed in claim 12, wherein the second mating port is smaller than the first mating port in a transverse direction perpendicular to both said vertical direction and said front-to-back direction.

18. A cable connector assembly comprising:

an insulative housing defining at least a mating port forwardly communicating with an exterior along a front-to-back direction;

a plurality of contacts disposed in the housing with front contacting sections exposed in the mating port and rear tail sections exposed outside of the housing;

a cable located behind the housing and extending rearwardly along a rearward oblique direction oblique to said front-to-back direction, said cable including a plurality of wires mechanically and electrically connected to tail sections of the corresponding contacts, respectively;

a metallic primary shell unitarily including a front frame like structure enclosing the housing and a rear U like structure extending along said oblique direction and enclosing a front portion of the cable; and a metallic secondary shell including another U like structure extending along the rearward oblique direction and assembled to said rear U like structure in another oblique direction oblique to the front-to-back direction while being perpendicular to said oblique directions wherein the front frame like structure forwardly extends along a forward direction which is oblique to said rearward direction at with obtuse angle therebetween.

19. The cable connector assembly as claimed in claim 18, wherein the frame like structure defines a first dimension in a vertical direction perpendicular to said front-to-back direction while oblique to both said oblique directions, and a combination of said rear like structure of the primary shell and said another U like structure of the secondary shell commonly define a second dimension along said another oblique direction, said first dimension being smaller than said second dimension.

20. The cable connector assembly as claimed 18, wherein said another U like structure defines a notch to accommodate a step structure of the housing, and the tail sections are supportably positioned upon the step structure.

* * * * *